United States Patent [19]

Grusin

[11] Patent Number: 5,040,681

[45] Date of Patent: Aug. 20, 1991

[54] DESK ORGANIZER OR THE LIKE

[75] Inventor: Gerald M. Grusin, Chicago, Ill.

[73] Assignee: Dart Industries Inc., Deerfield, Ill.

[21] Appl. No.: 19,155

[22] Filed: Feb. 26, 1987

[51] Int. Cl.[5] ..... B65D 21/00

[52] U.S. Cl. ..... 206/503; 206/371; 206/372; 206/505; 206/506; 206/509; 206/561; 220/23.6; 220/23.83

[58] Field of Search ..... 206/224, 371, 503, 508, 206/509, 557, 561, 815, 821, 505, 506, 372; 220/23.6, 23.83, 4 C, 4 D; D7/3, 43, 83, 354

[56] References Cited

U.S. PATENT DOCUMENTS

| | | | |
|---|---|---|---|
| D. 191,811 | 11/1961 | Levinson | D80/9 |
| D. 253,272 | 10/1979 | Ottier | D7/43 |
| D. 267,153 | 12/1982 | Lebowitz | D19/77 |
| 491,865 | 2/1893 | Wynn | 206/503 |
| 2,620,997 | 12/1950 | Lyon | 242/128 |
| 2,678,143 | 5/1954 | Dillingham et al. | 206/509 |
| 3,179,036 | 4/1965 | Luker | D7/43 |
| 3,392,874 | 7/1968 | Peebles | 206/509 |
| 3,398,827 | 8/1968 | Laskin | 206/65 |
| 3,623,634 | 11/1971 | Norgard | 220/97 |
| 3,627,122 | 12/1971 | Garbe, Jr. | 206/561 |
| 3,756,462 | 9/1973 | Cain | 220/23.83 |
| 4,311,237 | 1/1982 | Hayes | 206/503 |
| 4,410,099 | 10/1983 | de Larosiere | 206/509 |
| 4,579,489 | 4/1986 | Sarantities | 410/80 |
| 4,619,363 | 10/1986 | Wolfseder | 206/373 |

FOREIGN PATENT DOCUMENTS

| | | | |
|---|---|---|---|
| 543014 | 11/1941 | United Kingdom | 206/503 |

OTHER PUBLICATIONS

House Beautiful, Jan. 1978 p. 83; French Porcelain forms Pillivuyt's Ring Mold (pertinent figure).

*Primary Examiner*—David T. Fidei
*Attorney, Agent, or Firm*—John A. Doninger

[57] ABSTRACT

A desk organizer or the like includes a plurality of vertically stackable trays having partitions formed therein for storing articles of various sizes and shapes. Each tray has a hollow upright center post which is received within the center post of the tray positioned immediately on top of it. The posts have apertures formed in their distal ends and are so dimensioned that as the organizer is fully assembled each aperture is in closely spaced relation to the respective apertures in the posts of adjacent trays. When it is desired to manually separate particular trays to gain access to certain contents of the organizer, the user may insert the index finger of a single hand into the apertures and grip the desired number of posts, which allows one or more trays to be lifted and separated from the tray to which access is sought. A cover is provided with a knob-like projection having an aperture formed therein so that the cover may be gripped in a manner similar to the manner in which the trays are gripped.

12 Claims, 3 Drawing Sheets

DESK ORGANIZER OR THE LIKE

BACKGROUND OF THE INVENTION

1. Field of the Invention

The present invention relates generally to an improved organizer container for the storage of articles of diverse type, and it relates more particularly to a new and improved compact organizer container comprising simple stacked multiple trays which are manually separable with the use of only one hand.

2. Description of the Prior Art

Various storage containers are available for items of jewelry or for items used in an office environment such as paper clips, pens, and rubber bands, for example. Relatively small items of the foregoing type are easily stored in trays having dividers, or partitions, which serve to separate articles of different types thereby providing an organizing function. Often, the trays may be stackable such that multiple trays may be arranged in a compact unit. The later type of container, which offers the advantage of increased convenience, is illustrated, for example, in the patent to Lebowitz, U.S. Pat. No. D-267,153, issued on Dec. 7, 1982 and directed to a desk receptacle for writing instruments and/or writing supplies or the like.

A disadvantage of known storage containers such as organizers having multiple stacked trays, is the requirement of having to use two hands to manually separate the trays for gaining access to the various articles stored therewithin. In addition, mechanisms which might make separation of the trays convenient, such as hinge means, pivot structures or enclosed drawer arrangements, typically require the container to occupy additional space, therefore impairing its compactness. Accordingly, it would be desirable to provide a highly compact and efficient article storage organizer wherein access to the articles stored therewithin is easily gained with the use of only one hand. It would further be desirable to provide an article storage organizer which is more economically manufactured than present units and, thus, can be sold at a less expensive price.

SUMMARY OF THE INVENTION

Briefly, there is provided in accordance with the present invention a new and improved organizer container for storing articles, comprising a series of three stackable storage trays. Each storage tray has a bottom wall with an upstanding post member formed integrally therewith and extending generally perpendicularly thereto. The post members are hollow such that the post member of one tray is telescopingly received within the post member of a corresponding second tray as the trays are stacked one over another. The distal ends of each post member are formed with an aperture therein defining a lip. The respective post members are so dimensioned that the respective lips thereof are all arranged in closely spaced relationship one to another. A cover is provided for forming an enclosure in conjunction with the uppermost tray. The cover is also provided with an aperture formed in alignment with the stacked post members of the trays disposed therebeneath. Similarly to the apertures of the post members, the aperture of the cover defines a lip which is in close proximity to the lips of the underlying post members. By insertion of a finger through the aperture of the cover, one can selectively grip one or more lips of the post and cover apertures, and by a lifting motion can expose the contents of any one of the tray members comprising the container. A knob provided on the cover circumscribing the cover aperture serves as a gripping means for the user's thumb which facilitates the gripping of the post members of the respective trays. Thus, with a single hand the user may readily gain access to the articles stored in any one of the trays. In addition to its one-handed operability, the organizer container of the instant invention offers significant advantages in terms of simplicity of manufacture, thus resulting in an organizer container which is inexpensively priced.

BRIEF DESCRIPTION OF THE DRAWINGS

The foregoing and other novel features of the present invention will be better understood by reading of the following detailed description taken in connection with the accompanying drawings wherein.

DETAILED DESCRIPTION OF THE INVENTION

Figure 1:
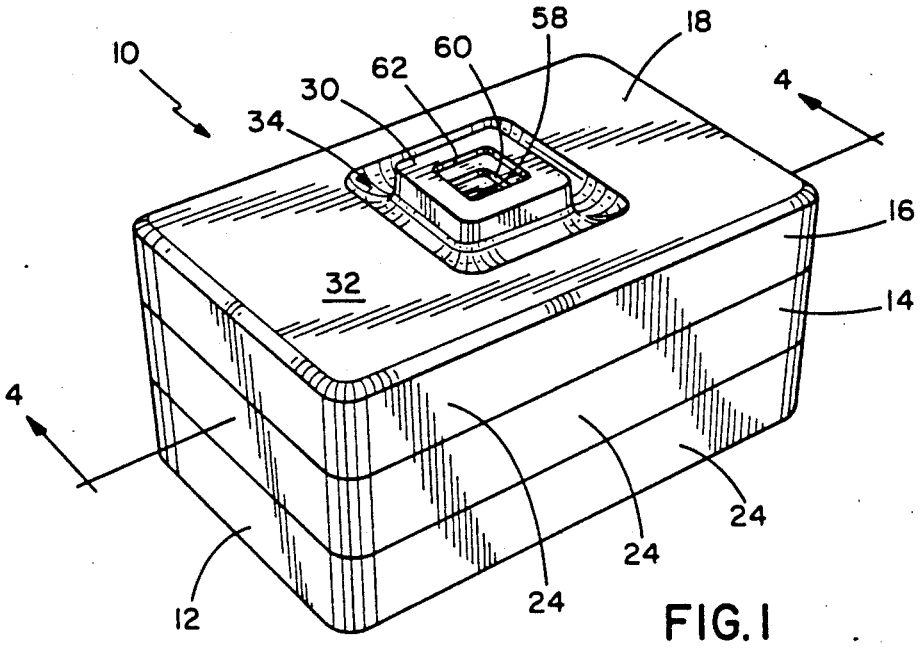
FIG. 1 is a perspective view of an assembled organizer container constructed in accordance with the principles of the invention.

Referring now to the drawings, and initially to FIG. 1, an organizer container, designated generally by the reference numeral 10, is illustrated as having an overall box-like configuration. The container 10 comprises as its principle components a bottom tray 12, an intermediate tray 14, a top tray 16 and a cover 18. In a manner which will be described in detail hereinafter, respective trays 12, 14 and 16 and cover 18 are stackable one on top of another to form a co-acting, unitary assembly 10.

Figure 2:
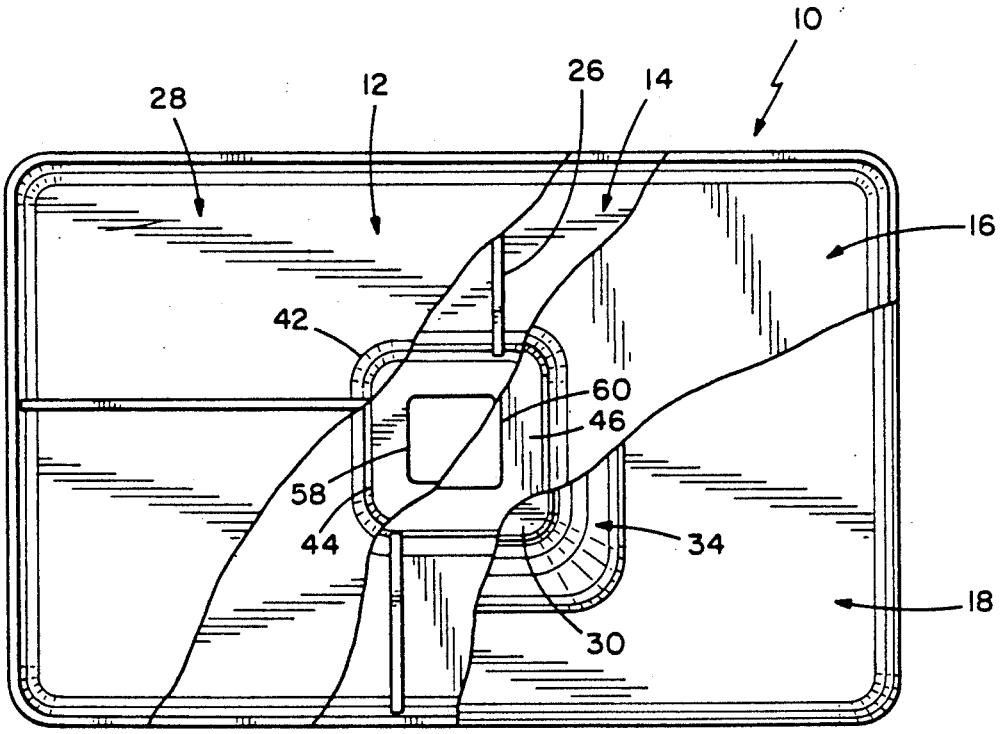
FIG. 2 is a top plan view of the organizer container of FIG. 1 illustrated as partially broken away to show portions of the various trays which comprise the container.
Figure 3:
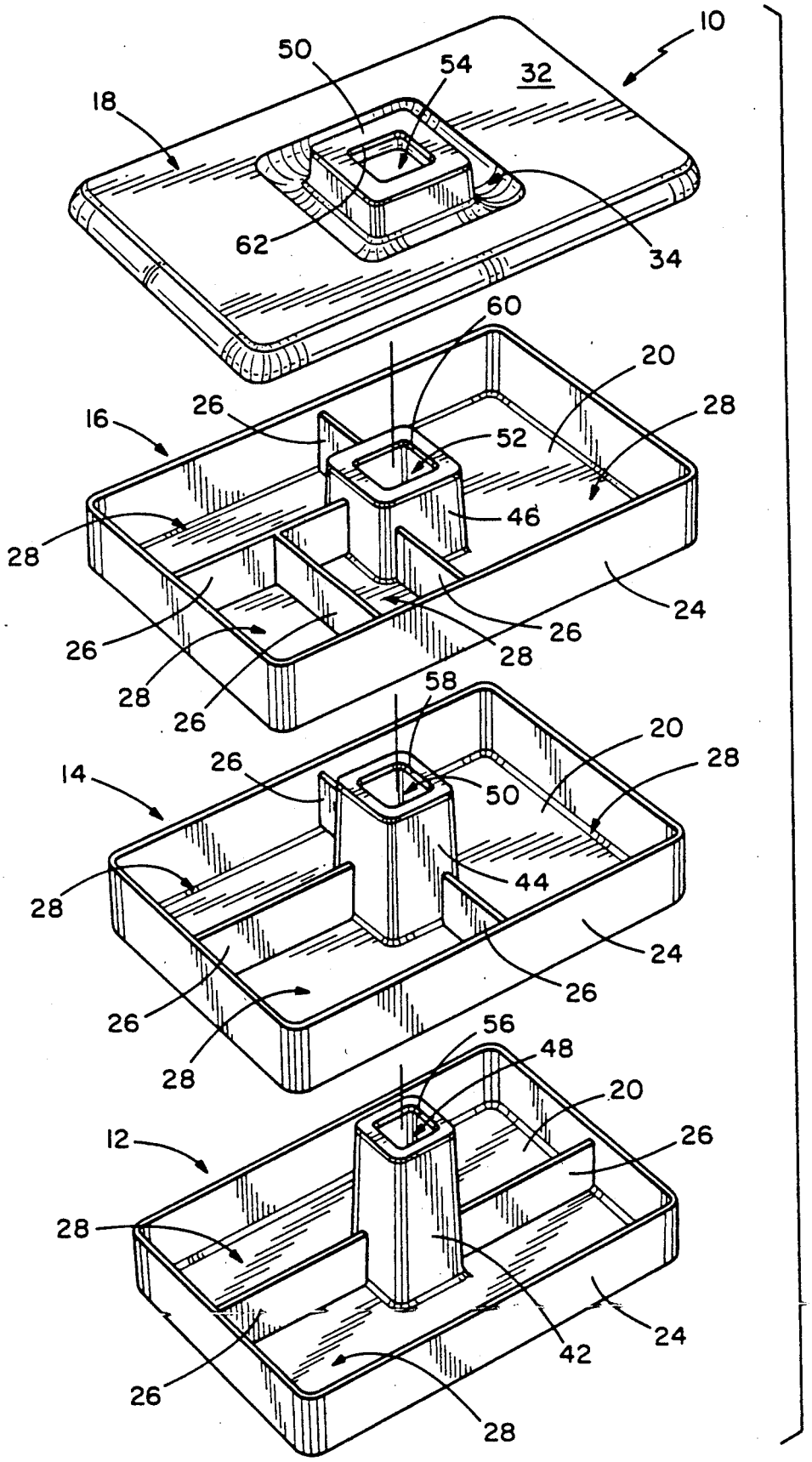
FIG. 3 is an exploded perspective view illustrating the component parts of the organizer container constructed in accordance with the principles of the invention.

Turning now to FIGS. 2 and 3, each of the trays 12, 14 and 16 can be seen to include a bottom wall 20 with a sidewall 24 formed integrally therewith and extending around the periphery thereof. A plurality of partitions 26 are arranged within the trays 12, 14 and 16 to form multiple compartments, designated generally by the reference numeral 28, of varying sizes and shapes. The compartments 28 provide means for storage of diverse articles and serve to divide each tray 12, 14 and 16 such that the articles will not co-mingle but can be readily identified and accessed within the organizer container 10. The partitions 26 can be arranged in any preselected configuration to provide compartments 28 having any suitable shape and size for storage of diverse articles of jewelry, office supplies or the like. Preferably, the cover 18 is provided with an integrally formed knob 30 which extends slightly above the upper surface 32 thereof. In addition, circumscribing the knob 30 is a recess 34, the purpose of which is to lend greater height to the knob 30 allowing for a cover 18 having a relatively low overall profile. The recess 34 and knob 30 construction therefore provides for a highly compact overall organizer container 10.

Figure 4:
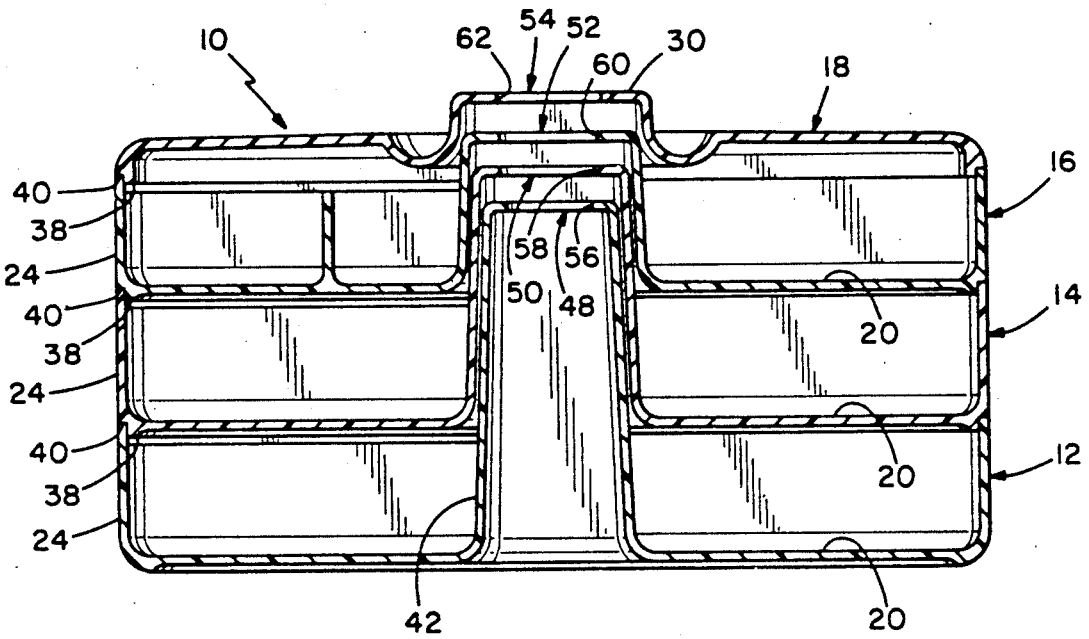
FIG. 4 is a cross-sectional view taken along the lines 4—4 of FIG. 1.

In order to provide for stackability of the trays 12, 14 and 16 and cover 18, as best seen in FIG. 4, the intermediate tray 14, the top tray 16, and the cover 18 are each provided with a downwardly extending peripheral rib 38 which, in turn, defines a respective shoulder 40 for the purpose of permitting self-aligning of the trays 14, and 16 and cover 18 in relation to the respective tray positioned immediately therebeneath, the shoulders 40 serving to receive the sidewalls 24 of respective trays 12, 14 and 16 thus providing for an overall organizer container 10 having a smooth-walled appearance. In accordance with the instant invention, stackability of the respective trays 12, 14 and 16 of the organizer container assembly 10 is further facilitated by the provision of a first post 42 formed integrally with the bottom tray 12, a second post 44 formed integrally with the intermediate tray 14 and a third post 46 formed integrally with the top tray 16. Preferably at least the second and third posts 44 and 46 have a hollow interior of respectively increasing dimension such that the first post 42 is telescopingly received within the second post 44 and the second post 44 is, in turn, telescopingly received within the third post 46. For purposes which will be explained in detail hereinafter, the knob 30 is also provided with a hollow interior such that it telescopingly receives the third post 46 of the top tray 16. Since each of the posts 42, 44 and 46 and the knob 30 are formed with a generally square cross-section, stacking of the component members 12, 14, 16 and 18 of the organizer container 10 automatically causes the respective members to self-align during assembly of the container 10.

An important aspect of the invention resides in the dimensions of the respective post members 42, 44 and 46. As best seen in FIG. 4, for example, the first post member 42 is relatively taller in overall dimension than the second post 44 of the intermediate tray 14. Moreover, the second post 44 is relatively taller in overall dimension than the third post 46 of the top tray 16. The result of this dimensional arrangement is that the distal ends of the post 42, 44, and 46 are all arranged in closely spaced relation one to another. In order to facilitate the manual separation of the various components 12, 14, 16 and 18 of the organizer container 10, each post member 42, 44 and 46 is provided with an aperture 48, 50 and 52, respectively, in the upper surface of its distal end. In addition, the knob 30 is provided with an aperture 54 positioned immediately above the aperture 52 of the third post member 46. Each aperture 48, 50, 52 and 54 is so dimensioned as to conveniently permit the insertion of a finger through the center of the knob 30, the third post member 46, the second post member 44, and the first post member 42. Each aperture 48, 50, 52 and 54 defines a respective lip 56, 58, 60 and 62 which can be grasped by the user's finger tip, in a manner which will be described hereinafter.

Operation

Figure 5:
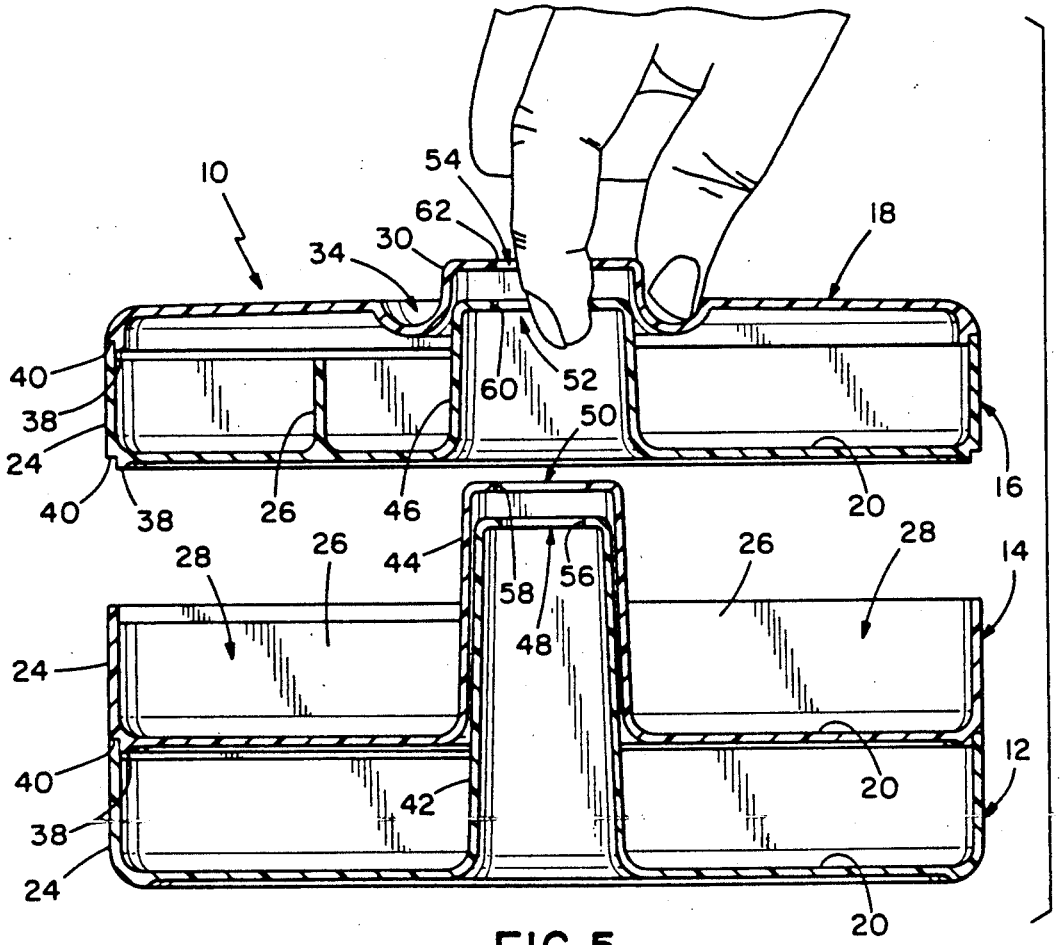
FIG. 5 is a cross-sectional view similar to FIG. 4 showing the manner in which the trays of the container may be separated in accordance with the principles of the invention.

The operation of the instant invention is best illustrated in the cross-sectional view of FIG. 5 wherein a user's hand is shown with the index finger partially inserted in the organizer container 10 through the knob aperture 54. As therein illustrated, the tip of the index finger extends to the level of the lip 60 of the third post member 46. The thumb of the hand is also inserted within the recess 34 of the cover 18 in abutment against the side of the knob 30. Compression between the index finger and thumb thus causes the third post 32 of the top tray 16 and the knob 30 of the cover 18 to be effectively grasped, whereupon the top tray 16 and cover 18 can readily be unstacked or dissociated from the bottom tray 12 and intermediate tray 14 thereby exposing the contents of the intermediate tray 14 for accessibility. Alternatively, when it is desired to expose the contents of the lowermost bottom tray 12, the user would simply insert the index finger to a greater depth at which level the tip of the finger would come in contact with the lip 58 of the second post member 44. Once again, compression between the index finger and thumb together with a subsequent lifting motion would cause the intermediate tray 14, the top tray 16 and cover 18 to all be simultaneously disassociated from the bottom tray 12 thereby exposing its contents. It can also be appreciated that if the tip of the index finger is inserted only to a level which would provide for gripping of the lip 62 of the knob 30, the cover would simply be removed exposing the contents of the top tray 16. Finally, when it is desired to lift the entire organizer 10 as a unitary assembly, the tip of the index finger can be inserted to the level which would provide for the gripping of the lowermost lip 56 of the first post member 42 thereby facilitating the gripping of all components of the container assembly 10 simultaneously.

It can now be appreciated that the organizer container 10 of the instant invention offers significant advantages over prior art means for arranging and storing articles of various types. Because each of the trays 12, 14, and 16 of the instant container 10 are similar in size and are stackable one atop another, the assembly 10 provides a structure which is not only readily manufacturable but is also compact and is therefore efficient in its storage capabilities. The provision of the center post arrangement wherein posts 42, 44 and 46 are telescopingly received one within another, not only serves to assist stackability of the trays 12, 14 and 16, but in accordance with the principles of the invention, provides means for conveniently grasping and separating the respective members 12, 14, 16 and 18 with one hand. The user's other hand is thereby free to conveniently reach for an article disposed within the organizer container 10 and once the article has been removed the organizer container 10 may be readily reassembled.

The organizer container 10 is illustrated with post members 42, 44 and 46 having generally square cross sections to provide for the self-aligning feature as heretofore described. However, any cross-sectional shape may be utilized. For example, where a cylindrically shaped container 10 is desired, a circular cross-sectional shape of the post members 42, 44 and 46 may be desirable. Moreover, while the first post 42 need not be hollow since it does not telescopingly receive another post member, it is nevertheless desirable to construct the bottom tray 12 with a post 42 having the hollow interior to economize in the manufacture of the organizer container 10. Further, while the apertures 48, 50 and 52 have been illustrated with a square configuration, these apertures can have virtually any shape, provided they are suitably dimensioned to conveniently receive a finger. In preferred form, the first aperture 48 is slightly smaller than the second aperture 50, which, in turn, is slightly smaller than the third aperture 52. As best seen in FIG. 4, for example, this arrangement allows for a slight tapering of the apertures 48, 50 and 52 inwardly from top to bottom making it easier to grip respective lips 56, 58 and 60 of the apertures 48, 50 and 52 respectively, as the finger is inserted therein. The container 10 is also of such simplicity in its structure as to be readily molded from plastic, for example.

While the present invention has been described in connection with particular embodiments, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed as new and desired to be secured under Letters Patent of the U.S. is:

1. An organizer for storing articles, comprising:

a first storage tray;

a first post member formed integrally with said storage tray and extending generally perpendicular thereto, said first post member having a distal end;

means associated with the distal end of said first post member for permitting gripping of said first post member;

a second storage tray adapted to be placed over and rest atop said first storage tray;

a second post member formed integrally with said second storage tray and having a hollow interior to telescopingly receive said first post member, said second post member having a distal end;

means associated with the distal end of said second post member for permitting gripping of said second post member simultaneously with the gripping of said first post member;

a cover adapted to be placed over and rest atop said second storage tray and having a knob formed integrally therewith, said knob having a hollow interior to telescopingly receive said second post member of said second tray; and means associated with said knob for permitting gripping of said knob, said second post member and said first post member simultaneously.

2. The organizer of claim 1 wherein said means for permitting gripping of said first post member comprises a first lip defined by a first aperture formed in the distal end of said first post member.

3. The organizer of claim 2 wherein said means for permitting gripping of said second post member comprises a second lip defined by a second aperture formed in the distal end of said second post member.

4. The organizer of claim 3 wherein said first and second lips are disposed in closely spaced relation one to another.

5. The organizer of claim 3 wherein said means for permitting gripping of said knob comprises a third lip defined by a third aperture formed in said knob.

6. The organizer of claim 5 wherein said first, second and third lips are all in closely spaced relation one to another.

7. The organizer of claim 1 wherein said first and second post members each have a non-circular cross-section.

8. The organizer of claim 7 wherein said knob has a non-circular cross-section.

9. The organizer of claim 1 wherein said knob is recessed into the outer surface of said cover.

10. The organizer of claim 3 wherein said first aperture is smaller in size than said second aperture.

11. The organizer of claim 5 wherein said third aperture is smaller in size than said second aperture.

12. In an organizer for storing articles, the combination therewith including:

a first storage tray;

a first post member formed integrally with said first storage tray and extending generally perpendicular thereto, said first post member having a distal end with an aperture formed therein defining a first lip;

a second storage tray adapted to be placed over and rest atop said first storage tray thereby defining a compartment between said trays for the storage of articles;

a second post member formed integrally with said second storage tray and having a hollow interior to telescopingly receive said first post member when said storage tray is placed atop said first storage tray, said second post member having a distal end with an aperture formed therein defining a second lip;

wherein said first post member is longer than said second post member such that said lips of said first and second post members are disposed in closely spaced relation one to another when said second storage tray is placed atop said first storage tray, whereby said first and second storage trays can be lifted simultaneously by insertion of a finger into said apertures and gripping said lips.

* * * * *